US005597794A

United States Patent [19]

Bauer et al.

[11] Patent Number: 5,597,794

[45] Date of Patent: Jan. 28, 1997

[54] PROCESS FOR THE PRODUCTION OF DETERGENT SURFACTANT GRANULES COMPRISING A RECYCLE STEP

[75] Inventors: Volker Bauer; Wilfried Raehse; Andreas Syldath, all of Duesseldorf; Ditmar Kischkel, Monheim, all of Germany

[73] Assignee: Henkel Kommanditgesellschaft auf Aktien, Duesseldorf, Germany

[21] Appl. No.: 324,317

[22] Filed: Oct. 17, 1994

Related U.S. Application Data

[63] Continuation of Ser. No. 956,486, filed as PCT/EP91/01190, Jun. 26, 1991 published as WO92/01036, Jan. 23, 1992, abandoned.

[30] Foreign Application Priority Data

Jul. 5, 1990 [DE] Germany ..... 40 21 476.1

[51] Int. Cl.$^6$ ..... C11D 11/00; C11D 3/04; C11D 3/12

[52] U.S. Cl. ..... 510/457; 510/349; 510/357; 510/359; 510/361; 510/470; 510/476; 510/495; 510/507; 510/509; 510/511; 510/536

[58] Field of Search ..... 252/89.1, 174, 252/174.25, 174.24, 135, 174.14, 550, 174.17, 558, 549, 531, 539, 530

[56] References Cited

U.S. PATENT DOCUMENTS

| | | | |
|---|---|---|---|
| 3,472,784 | 10/1969 | Poe | 252/138 |
| 3,706,672 | 12/1972 | Martin et al. | 252/142 |
| 3,904,685 | 9/1975 | Shahidi et al. | 252/174.24 |
| 4,255,274 | 3/1981 | Hensler et al. | 252/135 |
| 4,518,516 | 5/1985 | Godard et al. | 252/91 |
| 4,698,167 | 10/1987 | St. Laurert et al. | 252/117 |
| 4,726,908 | 2/1988 | Kruse et al. | 252/91 |
| 4,828,721 | 5/1989 | Bollier et al. | 252/140 |
| 4,925,585 | 5/1990 | Strauss et al. | 252/89.1 |
| 4,963,226 | 10/1990 | Chamberlain | 252/135 |
| 5,009,804 | 4/1991 | Clayton et al. | 252/99 |
| 5,045,238 | 9/1991 | Jolicoeur | 252/550 |
| 5,066,425 | 11/1991 | Ofosu-Asante et al. | 252/546 |
| 5,080,848 | 1/1992 | Strauss et al. | 264/117 |
| 5,152,932 | 10/1992 | Mueller et al. | 252/550 |
| 5,164,108 | 11/1992 | Appel et al. | 252/174 |
| 5,178,798 | 1/1993 | Jolicoeur | 252/553 |
| 5,318,733 | 6/1994 | Carduck et al. | 264/15 |
| 5,397,507 | 3/1995 | Bauer et al. | 252/549 |

FOREIGN PATENT DOCUMENTS

| | | |
|---|---|---|
| 0191396 | 8/1986 | European Pat. Off. . |
| 0342917 | 11/1989 | European Pat. Off. . |
| 0349200 | 1/1990 | European Pat. Off. . |
| 0364881 | 4/1990 | European Pat. Off. . |
| 324201 | 9/1957 | Switzerland . |
| WO9003977 | 4/1990 | WIPO . |

OTHER PUBLICATIONS

H. Baumann "Neuere Entwicklungen auf dem Gebiet Fettchemischer Tenside" Fat Sci. Technol., 92 (1990) 49–50.

*Primary Examiner*—Ardith Hertzog
*Attorney, Agent, or Firm*—Wayne C. Jaeschke; John E. Drach; Daniel S. Ortiz

[57] ABSTRACT

The invention is a process for producing surfactant granules by mixing a water-containing surfactant with a solid to form granules, drying the granules and recycling the dried granules as a portion of the solid.

16 Claims, No Drawings

PROCESS FOR THE PRODUCTION OF DETERGENT SURFACTANT GRANULES COMPRISING A RECYCLE STEP

This application is a continuation of application Ser. No. 07/956,486, filed as PCT/EP91/01190, Jun. 26, 1991 published as WO92/01036, Jan. 23, 1992 now abandoned.

BACKGROUND OF THE INVENTION

This invention relates to a process for converting aqueous preparations of washing- and cleaning-active surfactant compounds into storable granules.

Considerable and greatly increasing significance is attributed to the use of oleochemical surfactant compounds in detergents. On the one hand, the principal considerations in this regard are based on the fact that surfactant compounds of this type can be obtained from renewable vegetable and/or animal raw materials. On the other hand, however, crucial significance is attributed in particular to the high ecological compatibility of selected components of this type. One example of such a class of oleochemical surfactant compounds are the known fatty alcohol sulfates which are produced by sulfation of fatty alcohols of vegetable and/or animal origin predominantly containing 10 to 20 carbon atoms in the fatty alcohol molecule and subsequent neutralization to water-soluble salts, more particularly the corresponding alkali metal salts. Of particular practical significance in this regard are the sodium salts of fatty alcohol sulfates which are based on at least predominantly linear fatty alcohols or corresponding fatty alcohol mixtures containing approximately 12 to 18 carbon atoms in the fatty alcohol molecule. Tallow alcohol sulfates (TAS) with predominantly saturated $C_{16-18}$ residues in the fatty alcohol are already of considerable importance for the production of laundry detergents, particularly in solid form, although fatty alcohol sulfates (FAS) with a broader C chain length range also have important detergent properties. Thus, $C_{12-18}$ fatty alcohol sulfates containing a high percentage of the lower fatty alcohols in this range, for example based on coconut oil or palm kernel oil, are particularly important anionic surfactants for use in detergents. There are numerous disclosures to this effect in the relevant specialist literature, cf. H. Baumann "Neuere Entwicklungen auf dem Gebiet fettchemischer Tenside" Fat Sci. Technol., 92 (1990) 49/50 and the earlier literature cited therein. Similarly, European patent application 342 917 describes detergents in which the anionic surfactants consist predominantly of $C_{12-18}$ alkyl sulfates.

The economic synthesis of light-colored FAS-based anionic surfactants is now an established part of technical knowledge. The corresponding surfactant salts are obtained in the form of aqueous preparations with water contents in the range from about 20 to 80% and, more particularly, in the range from about 35 to 60%. Products of this type have a paste-like to cuttable consistency at room temperature, the flowability and pumpability of the pastes being limited or even totally lost for active substance contents of only about 50% by weight, so that considerable problems arise in the subsequent processing of the pastes, particularly during their incorporation in solid mixtures, for example in solid detergents. Accordingly, there has long been a need to provide FAS-based detergent surfactants in dry, more particularly free-flowing form. It is in fact possible to produce free-flowing FAS powders by conventional drying techniques, more particularly by spray drying. However, serious limitations have been discovered in this regard and, above all, call the economy of using FAS surfactants on an industrial scale into question. Tower-dried TAS powder, for example, has a very low apparent density, so that unprofitable conditions prevail in the packaging and marketing of this detergent raw material. However, even at the production stage of the tower powders, questions of safety can necessitate such heavily restricted operation of the tower drying process that practical difficulties arise. Thus, safety studies of tower powders based on TAS or FAS containing 20% or more of active substance show that the spray drying of such formulations is possible on only a very limited scale and, for example, requires tower entry temperatures below 200° C.

Comparable or other difficulties arise in the conversion of aqueous, more particularly paste-form, preparations of many other washing- and cleaning-active surfactant compounds into storable dry products. Further examples of anionic oleochemical surfactant compounds are the known sulfofatty acid methyl esters (fatty acid methyl ester sulfonates, MES) which are obtained by α-sulfonation of the methyl esters of fatty acids of vegetable and/or animal origin predominantly containing 10 to 20 carbon atoms in the fatty acid molecule and subsequent neutralization to water-soluble monosalts, more particularly the corresponding alkali metal salts. Ester cleavage thereof gives the corresponding α-sulfofatty acids or their disalts which, in the same way as mixtures of disalts and sulfofatty acid methyl ester monosalts, show important intrinsic washing and cleaning properties. However, comparable problems also arise in other classes of surfactants when attempts are made to produce the corresponding surfactant raw materials in dry form, cf. washing- and cleaning-active alkyl glycoside compounds. To obtain light-colored reaction products, their synthesis generally has to be completed by a bleaching step, for example using aqueous hydrogen peroxide, so that in this case, too, modern technology leads to the aqueous paste form of the surfactant. Water-containing alkyl glycoside pastes (APG pastes) are more vulnerable, for example, to hydrolysis or microbial contamination than corresponding dry products. In their case, too, simple drying by conventional methods presents considerable difficulties. Finally, however, even the drying of a water-containing paste of the alkali metal salts of washing-active soaps and/or alkylbenzene sulfonates (ABS pastes) can also present considerable problems.

The problem addressed by the present invention was to provide a simple alternative method of processing water-containing, more particularly paste-form, surfactant preparations to dry, more particularly free-flowing and concentrated surfactant granules.

DESCRIPTION OF THE INVENTION

The present invention relates to a process for the production of washing- and cleaning-active surfactant granules by granulation of a mixture of a water-containing surfactant preparation and one or more water-soluble and/or water-insoluble solids, so that free-flowing granules are formed. Granules containing at least 20% by weight surfactants are formed in this process. The production of granules containing at least 25% by weight surfactants is preferred.

The invention is described in more detail in the following with reference by way of example to the conversion of water-containing FAS pastes into free-flowing granules. Taking general chemical knowledge into consideration, the measures and process parameters described in detail hereinafter may also be broadly applied to other water-containing, more particularly paste-form, surfactant preparations of the type in question.

The water-containing FAS mixtures preferably used are the reaction products of comparatively high water content from the sulfation and subsequent aqueous/alkaline neutralization of the particular fatty alcohol used. The mixtures in question are generally mixtures of corresponding FAS types of different chain length with a preferably linear fatty alcohol radical in the $C_{12-18}$ range mentioned. The water content of these FAS mixtures is preferably in the range from about 20 to 80% by weight and, more preferably, in the range from about 30 to 50% by weight, flowable and/or pumpable water-containing FAS pastes being particularly convenient to use. The working temperature (temperature of the surfactant paste) is room temperature or a moderately elevated temperature of up to at most about 60° to 70° C. Coordinating the working temperature and the water content of the surfactant paste can be useful to the extent that it guarantees safe dosability of the water-containing FAS mixture used. The granulation process is carried out as follows:

In a suitable mixer/granulator, for example in corresponding machines of the Eirich mixer, Lödige mixer (for example a Lödige ploughshare mixer) or Schugi mixer type, the aqueous FAS mixture on the one hand and water-soluble and/or water-insoluble solids on the other hand are introduced in such quantities at peripheral speeds of the mixing elements of preferably 2 to 7 m/s (ploughshare mixer) or 5 to 50 m/s (Eirich, Schugi) and, more particularly, at peripheral speeds of 15 to 40 m/s and are mixed with one another so intensively that free-flowing granules are formed. At the same time, a predetermined particle size of the granules can be established in known manner. The mixing process takes only a very short time, for example from about 0.5 to 10 minutes and, more particularly, from about 0.5 to 5 minutes (Eirich mixer, Lödige mixer), to homogenize the mixture to form the free-flowing granules. By contrast, in Schugi mixers, a residence time of 0.5 to 10 seconds is normally sufficient to obtain free-flowing granules. The ratios in which the components are mixed and, in particular, the quantities of solid added have to be coordinated with the amount of water introduced through the FAS mixture so that the homogenized mixture of water-containing surfactant preparation and added solid is able to form the free-flowing granules. Normally, more solid is required, the higher the water content of the surfactant mixture. At all events, prolonged storability of the free-flowing granules initially formed is not necessary. According to the invention, the still moist granules are transferred immediately after granulation to the drying stage which, in the preferred embodiment, is carried out by fluidized-bed drying. In principle, however, the drying step is not necessary for producing the free-flowing granules. However, drying is advantageous and therefore preferred because surfactant granules of increased surfactant content can be obtained in this way. It may be necessary, particularly in cases where surfactant mixtures of low concentration—for example containing more than 50% by weight and, in particular, more than 60% by weight water—are used, to dry the granules initially formed in order to obtain the desired minimum content of 20% by weight surfactant in the granules. Drying may be continued to the desired final content of unbound or even bound water in the granules.

In another preferred embodiment, undried granules are mixed in any ratio with partly or completely dried granules. "Completely dried" is understood to mean the stage in which the unbound water and parts of the bound water, if any, were removed from the granules.

Fluidized bed drying is a preferred method of drying because the outer surface of the granules is rapidly dried while the granules are intensively moved and mixed with one another so that unwanted agglomeration of the still moist granules is counteracted in this way.

In one particular embodiment, it is possible in the described mixing and granulation stage to produce granules with such a degree of tackiness that, basically, the granules could be expected to stick together to such an extent that they could not be separated in the immediately following drying stage. Now, according to the invention, the still moist granules accumulating are powdered with a dust- or powder-form auxiliary, best immediately after their formation, and the granules thus intermediately stabilized are transferred to the drying stage. In the drying stage, the state of the free-flowing granule is rapidly established, even under mild drying conditions.

Drying, more particularly fluidized-bed drying, is preferably carried out at temperatures of the gas phase below 200° C. and, more particularly, at temperatures in the range from about 70° to 160° C., for example at temperatures in the range from about 90° to 150° C. These temperatures apply primarily to the gas phase. In one preferred embodiment, the final granule temperature to be established is kept at comparatively low temperatures and, for example, does not exceed 80° to 90° C. and is preferably no higher than 75° C.

The solids used for partly drying the water-containing surfactant preparation in the granulation stage may be corresponding ingredients of typical formulations of detergents and/or cleaning preparations, although they may even be foreign substances providing they are compatible with the application envisaged for the surfactants. In general, however, the solids in question will preferably be ingredients of detergents and/or cleaning preparations. One particular advantage of the process according to the invention lies in the very considerable freedom of choice in regard to these solid mixture components. This is attributable to the fact that the granulation process according to the invention with its—preferably following drying stage is carried out under such comparatively mild operating conditions that unwanted secondary reactions during the granulation and/or drying step are only likely to occur in special cases. General specialist knowledge may be used in this regard. Thus, particularly temperature-sensitive mixture constituents, for example of laundry detergents, such as are used for example as bleaches of the perborate type, will have relatively little significance. Preference is attributed to water-soluble and/or water-insoluble solids which can be safely mixed with the water-containing surfactant preparations under the working conditions, granulated and subsequently dried under the described working conditions. Accordingly, typical examples of suitable water-soluble solids are inorganic salts, for example soda, alkali metal silicates, more particularly waterglass powder, sodium sulfate and/or phosphate salts, such as sodium pyrophosphate and sodium tripolyphosphate.

According to the invention, however, the water-soluble solids may even be replaced in the granulation stage by corresponding insoluble, preferably fine-particle materials. The preferred solids preferably have a particle size of less than 1 mm and, more preferably, less than 100 μm, for example not more than 30 μm. Typical examples from the field of detergents and/or cleaning preparations are additives which may be used as so-called builders for binding alkaline earth metal ions and hence for eliminating water hardness. Examples are fine-particle crystalline zeolites, more particularly sodium zeolite NaA of detergent quality, of which at least 80% preferably consists of particles smaller than 10 μm in size. Other examples of preferred solids are hydrotalcites, water-insoluble and crystalline layer silicates, abrasives, such as crushed rock, and the like.

One particular feature of the invention is the use of preferably dried and finely size-reduced granules from the production line as a solid mixture constituent for working up further quantities of the water-containing surfactant preparations. In this embodiment of the invention, the granules produced by the process according to the invention, more particularly the dried granules, are completely or partly recycled. This embodiment is described in more detail hereinafter.

So far as the particular mixing ratios to be used in the mixing and granulation stage between the surfactants on the one hand and the solids on the other hand are concerned, it can be useful to adapt these constituents of the mixture to the corresponding demand for the components in the detergents and/or cleaning preparations to be ultimately produced. More particularly, the ratio of anionic surfactants to the fine-particle solids used, for example, in laundry detergents can provide reference points for the composition of the mixture to be granulated. The need to use various solid detergent constituents—best also in coordinated quantitative ratios—may derive from such considerations. This is generally the case when the water content of the aqueous surfactant mixture necessitates the use of such large quantities of dry solids that the quantity of this solid in the granules formed would be disproportionately large for the application envisaged. This is illustrated by the following example:

The waterglass content of laundry detergents, based on the formulation as a whole, is comparatively small, for example between 2 and 5% by weight of the formulation as a whole. By contrast, however, it may be desirable to incorporate very much larger quantities of fatty-alcohol-based anionic surfactant of the order of 20 to 30% by weight, based on the formulation of the final detergent. If an FAS surfactant mixture comparatively rich in water is used to carry out the process according to the invention, considerably larger quantities of waterglass would have to be incorporated (where waterglass powder is used as sole solid) to establish the state of a free-flowing powder in the mixing and granulation stage than would be desirable in the final detergent formulation. In this case, therefore, it is advisable to use other dry detergent constituents, for example soda and/or sodium sulfate.

If, on the other hand, the solids used are present or may at least be present in large quantities in typical detergent formulations, the desired percentage composition of the granules according to the invention may be coupled with the proportional mixture determined in advance by the full detergent formulation. Typical examples of this are mixtures of the water-containing surfactant pastes with sodium zeolite, soda and/or sodium sulfate.

In one particularly important embodiment of the invention, the granules, preferably the dried granules, are partly or completely recycled to the mixing and granulation stage, as mentioned above. In preferred embodiment, the process may be carried out, in particular continuously, in such a way that the entire solid phase added in the mixing and granulation stage is formed from recycled material which consists of already dried granules and which therefore already contains considerable quantities, i.e. preferably more than 25% by weight, based on the dried granules used as the solid. The dried granules used as solid in the mixing and granulation stage are first size-reduced under the effect of the mixing tools. They may be recycled once or even several times, for example 2 to 8 times. The advantages of carrying out the process according to the invention in this way are quite clear: surfactant can be enriched in the granules to fixed values determined in advance. By virtue of the comparatively low melting points of important laundry surfactants, for example FAS compounds and, in particular, corresponding FAS mixtures, enrichment of the granules to an approximately 100% surfactant mass will be of secondary importance in practice. However, where the process is carried out in this way, considerably higher contents can be established in the granules than in a single passage of the water-containing mixture through the mixing and granulation zone. In the embodiment where the granules are recycled, FAS contents of at least 30% by weight and preferably at least 35% by weight can readily be established in the granules. According to the invention, the corresponding surfactant content can be increased to at least 45% by weight or even to at least 50% by weight. A surfactant content of 30 to 75% by weight, based on the dried granules, is particularly preferred. The higher the surfactant content of the granules, the greater can be the tendency of the mixture to soften under the conditions of fluidized bed drying. The above-mentioned powdering with solid dry mixture components, for example with dried zeolite NaA of detergent quality, can be particularly useful in this regard.

The particle size range of the granules formed and the average particle size are established in known manner by adapting the working conditions in the granulation stage. According to the invention, granules having particle sizes in the range from about 0.01 to 3 mm (sieve analysis) and, more particularly, in the range from about 0.05 to 2 mm can readily be produced. In one important embodiment of the invention, the dried granules are graded in known manner by removing unwanted fine and coarse fractions. In another important embodiment of the invention, the fractions removed can be returned to the mixing and granulation stage and used as solids even when no provision has been made to recycle the granulated and dried granules.

The physical properties of the granules may also largely be predetermined in other ways. For example, the hardness of the granules and, above all, their abrasion hardness can be modified and, for example, increased by using suitable auxiliaries. This can be done by using small quantities of polymer compounds of the type typically used in detergents and cleaning preparations. The polyacrylates and polyacrylate copolymers known as builders are mentioned by way of example in this regard and may be used, for example, with relative molecular weights in the range from 30,000 to 100,000. Auxiliaries of this type may actually be added to the mixture in the mixing and granulation stage, although they may also be subsequently applied to the preformed granules before or during the drying process.

However, the process according to the invention may also be modified in a totally different form to facilitate the production of granules of the described type. For example, not only is it possible to use water-containing surfactants in the mixing and granulation stage, other desired components of the final detergent and/or cleaning preparation may be introduced into this stage of the process at least partly in the form of water-containing material. This modification is illustrated by the following example: it is known that zeolite NaA accumulates during its production in the form of an aqueous suspension (master batch) which may contain more than 50% by weight water and which is usually worked up by spray-drying into a powder-form dry product. According to the invention, the zeolite may be introduced into the mixing and granulation stage at least partly in the form of this suspension or even as a partly dried product and then dried in the mixture with the surfactant and the added dry solids in the granules. An embodiment such as this can be particularly interesting when the dried granules are recycled and the proportion required as the solid is introduced into the mixing and granulation stage in this way via the desired end product.

Zeolite materials of the type just mentioned and also other auxiliaries typically used in detergents and cleaning preparations are in turn capable of partly binding water. Examples of auxiliaries of this type are anhydrous soda and anhydrous sodium sulfate which are capable of binding considerable quantities of water in the form of water of crystallization. One embodiment of the invention uses this ability to internally dry water for additionally drying (internally drying) the granules formed in the process according to the invention. However, the following observation has been made in this regard: if, for example, water-containing FAS pastes and water-free soda or water-free sodium sulfate are mixed and granulated in such quantitative ratios that virtually all the water introduced by the FAS paste is bound by crystal binding of this water to soda or sodium sulfate, the granulation process can still be carried out, but the products formed are not entirely satisfactory. Corresponding granules of, for example, soda and FAS paste, which are solid and free-flowing at room temperature, stick together during storage, particularly if they are exposed to mildly elevated temperatures in the meantime. Thus, where solids which bind water of crystallization are used, it may be preferred in one embodiment of the invention to reduce the water content in the drying step to such an extent that the bound water present as water of crystallization is at least partly removed. Accordingly, the water contents of the preferred dried granules according to the invention are comparatively low. Their unbound water content is preferably below 5% by weight and, more preferably, below 3% by weight, based on the dried granules. Water bound in crystal-like form or water bound in the molecular structure may be present in limited quantities in the mixture although the stability of the granules in storage is higher, the less in particular the content of water of crystallization in the end product is reduced. This embodiment is of course of relatively little significance in cases where the surfactant granules are to be directly further processed. If the granules are to be marketed as raw materials in this form, the considerations just discussed will be of greater significance. By contrast, granules which are to be directly further processed and which do not require drying may have a considerably higher content of free water, although it should not exceed 30% by weight, based on the undried granules.

The granules according to the invention may have an increased apparent density, particularly by comparison with corresponding spray-dried materials. Typical granules according to the invention normally have an apparent density of at least about 350 g/l and preferably of at least about 500 g/l. Apparent densities of 600 to 800 g/l are particularly preferred.

As mentioned at the beginning, the process according to the invention may be used on a broad scale in regard to the water-containing surfactant mixtures. These mixtures encompass in particular mixtures of surfactants which are present as sufficiently dimensionally stable solids at room temperature and which, particularly during their production and/or working up, are present as aqueous pastes in which the surfactants are dispersed in the aqueous phase. One important example of surfactants such as these are the sulfofatty acid methyl ester monosalts and/or the so-called disalts. Even in their production on an industrial scale, the monosalts of sulfofatty acid methyl esters (MES) are formed in admixture with limited quantities of disalts which are formed by partial ester cleavage with formation of the corresponding α-sulfofatty acids or their disalts. The disalt content of MES-based surfactants is typically below 50 mol-% of the anionic surfactant mixture, for example of the order of up to about 30 mol-%. The teaching according to the invention is suitable for application to MES-based surfactant mixtures such as these and to corresponding mixtures with higher disalt contents up to and including pure disalts.

A preferred aqueous MES starting material are the reaction products of comparatively high water content from the sulfonation and subsequent aqueous/alkaline neutralization of the particular fatty acid methyl ester. The reaction products in question are generally mixtures of corresponding MES types of different chain length with preferably linear fatty acid residues in the $C_{12-18}$ range mentioned. The water content of these MES crude products may be in the range from about 20 to 80% by weight and, more particularly, is in the range from about 30 to 60% by weight. It can be particularly convenient to use flowable and/or pumpable water-containing MES pastes.

Surfactant compounds based on alkyl glycosides and their production, particularly in the form of water-containing bleached pastes, are described in detail, for example, in International patent application WO 90/03977. Surface-active reaction products of this type are another example of the suitability of the process according to the invention for the production of dry surfactant-based granules. The process according to the invention may be used quite generally for working up water-containing preparations of surfactant compounds at least substantially solid at room temperature from the class of anionic, nonionic, zwitterionic and/or cationic surfactants, corresponding surfactant compounds of high ecological compatibility preferably being selected.

EXAMPLES

EXAMPLE 1

1.5 kg of an aqueous tallow fatty alcohol sulfate mixture containing 54% by weight tallow fatty alcohol sulfate, 5% by weight unsulfonated fatty alcohol and salts and also 41% by weight water (Sulfopon T 55, a product of Henkel KGaA) were granulated with 1.5 kg spray-dried hydrated sodium zeolite A for 1 minute at 24 m/s in a 10 liter Eirich mixer. The granules were then dried in a fluidized bed (Aeromatik) for 60 minutes at an air entry temperature of 70° C. Free-flowing granules containing 7.7% by weight water and having an apparent density of 603 g/l were obtained. The drying time could be shortened to 20 minutes and 10 minutes, respectively, by increasing the air entry temperature to 110° C. and 150° C. The product had a tallow fatty alcohol sulfate content of 33.5% by weight and a water content below 1% by weight. Its apparent density was 650±30 g/l, depending on the fine-particle and coarse-particle fraction.

EXAMPLE 2

Quantities of 1.5 kg of the tallow-based fatty alcohol sulfate mixture (Sulfopon T 55) were granulated with 1.5 kg soda, 1.5 kg zeolite NaA and 3 kg crystalline layer silicate (SKS-6, a product of Hoechst) and dried as in Example 1.

500 g of the tallow fatty alcohol sulfate mixture were then applied to the granules formed in an Eirich mixer. The granules of increased anionic surfactant content were again dried in a fluidized bed (Aeromatik). This process could be repeated 7 times with soda as carrier, 4 times with zeolite NaA as carrier and 8 times with the layer silicate mentioned as carrier without the granules adhering to one another in the mixer or in the fluidized bed. The anionic surfactant content of the granules was 70% by weight based on soda, 57% by weight based on zeolite and 55% by weight based on the layer silicate. In no case was the water content of the granules more than 1% by weight. The apparent densities of the materials were respectively 610 g/l, 650 g/l and 660 g/l.

EXAMPLE 3

By powdering the material (carrier soda) recycled 7 times with 100 g soda, the granules were prevented from sticking to one another during subsequent mixing. By powdering in this way and subsequently applying more surfactant paste, it was possible to obtain a shell-like structure of the granules.

EXAMPLE 4

As in Example 1, the aqueous fatty alcohol sulfate paste was granulated with a mixture of soda and carboxymethyl cellulose (ratio 88:12) and dried. The granules strengthened by long-chain polymers were found to be more stable to abrasion than the comparison material of Example 1.

EXAMPLE 5

1.5 kg of a water-containing paste of 53% by weight sodium monosalt of sulfotallow fatty acid methyl ester, 11% by weight disodium salt of sulfotallow fatty acid, 3% by weight unsulfonated components and salts and 33% by weight water (Texin ES68, a product of Henkel KGaA) were granulated with 1.5 kg soda for about 3 minutes at 36 m/s in a 10 liter Eirich mixer ("Sternwirbler"). The granules were then dried in a fluidized bed (Aeromatik) for 60 minutes at an air entry temperature of 70° C. Free-flowing granules containing 2.4% by weight water and having an apparent density of 721 g/l were obtained. The washing-active substance content (sulfotallow fatty acid methyl ester and disalt content) of the granules was 37.2% by weight for a disalt content of 6.5% by weight (disalt content increased by ester cleavage of the monosalt). Water contents of 1.2% by weight and 0.9% by weight for washing-active substance contents (WAS) of approx. 38% by weight and disalt contents of approx. 70% by weight were established after a drying time of only 20 minutes by increasing the air entry temperature to 110° C. and 150° C., respectively. The granules had apparent densities of 620 g/l and 520 g/l.

After drying for 20 minutes at an air entry temperature of 70° C., a corresponding test with sodium sulfite as carrier material produced granules containing 0.8% by weight water for a washing-active substance content of 39% by weight, of which 7% by weight was disalt. These granules had an apparent density of 664 g/l.

EXAMPLE 6

As in Example 5, 1.5 kg of the water-containing sulfotallow fatty acid methyl ester paste was granulated with 1.5 kg soda in a mixer and dried. Another 250 g of the aqueous sulfotallow fatty acid methyl ester paste were then applied to the granules formed. The granules now accumulating with their increased anionic surfactant content were again dried in a fluidized bed. The end product had a WAS content of 44% by weight and an apparent density of 670 g/l for a water content of less than 1% by weight.

EXAMPLE 7

1400 g of an aqueous $C_{12}$ alkylbenzene sulfonate paste (ABS paste, water content 40% by weight) were granulated as in Example 5 with 2200 g soda in an Eirich mixer and then dried for 20 minutes at an air entry temperature of 110° C. Quantities of 250 g ABS paste were applied to the granules formed (24% by weight ABS, 9% by weight $H_2O$) in two steps. After each step, the granules produced in the Eirich mixer were dried in a fluidized bed for 40 minutes at 110° C. The end product contained 2.2% by weight water and approx. 32% by weight ABS and had an apparent density of 631 g/l.

EXAMPLE 8

In the same way as described in the preceding Examples, 1000 g of a 55% by weight $C_{12-14}$ alkyl glucoside paste (APG paste) and 2000 g water were worked up in an Eirich mixer to form granules having an apparent density of 800 g/l. In another step, another 500 g APG paste were applied to the granules in the Eirich mixer and dried to form granules of increased surfactant content.

EXAMPLE 9

3.0 kg of the water-containing sulfotallow fatty acid methyl ester paste (composition as in Example 5) were granulated with 1.5 kg sodium carbonate in a mixer with a high-speed blade (peripheral speed 24 m/s). The granules obtained had a WAS content of 41% by weight for a water content of 20% by weight and an apparent density of 537 g/l.

EXAMPLE 10

3.0 kg of an aqueous tallow fatty alcohol sulfate mixture (composition as in Example 1) were granulated with 3.0 kg sodium carbonate as in Example 9. The granules obtained had an anionic surfactant content of 27.5% by weight for a water content of 20% by weight and an apparent density of 625 g/l.

EXAMPLE 11

In a continuous mixer (Schugi, peripheral speed of the blades 31 m/s), 100 kg/h of a water-containing tallow fatty alcohol sulfate paste (composition as in Example 1) were sprayed onto 150 kg of a soda/zeolite mixture (1:1) at a temperature of 60° C. The granules obtained had an anionic surfactant content of 22% by weight and an apparent density of 400 g/l. The water content was reduced to below 2% by weight by subsequent fluidized-bed drying at 90° C.; the anionic surfactant content was 28% by weight. The dried granules had an apparent density of 350 g/l.

EXAMPLE 12

1 kg of the water-containing tallow fatty alcohol sulfate paste (Sulfopon T 55) were applied at 60° C. to 2 kg of a mixture of sodium carbonate and zeolite powder in a ratio of 1:1 in a Lödige ploughshare mixer at a peripheral speed of the ploughshares of 4 m/s (peripheral speed of the high-speed blades, so-called "choppers", variable between 10 and 21 m/s and preferably between 15 and 21 m/s). The granules formed had an anionic surfactant content of 18% by weight and an apparent density of 620 g/l. Granules having anionic surfactant contents above 21% by weight were obtained by partial removal of water in the fluidized bed.

What is claimed is:

1. A process for production of surfactant granules comprising at least one surfactant selected from the group consisting of fatty alcohol sulfates, sulfofatty acid methyl esters, sulfofatty acid disalt, alkyl glycosides, fatty acid soaps, and alkyl benzene sulfonates which comprises: mixing in a mixing zone, a mixture comprising the surfactant and from 20% to 80% by weight water with an amount of at least one solid selected from the group consisting of water soluble solids and water insoluble solids, sufficient to form granules when dried, comprised of at least about 20% by weight of surfactant; drying the granules to form dried granules; and introducing at least a portion of the dried granules into the mixing zone as at least a portion of the solid whereby the surfactant content of the dried granules is increased above the surfactant content of dried granules produced without introduction of dried granules into the mixing zone.

2. The process of claim 1 further comprising the step of drying said granules in a fluidized bed.

3. The process of claim 2 wherein the temperature of the gas phase used in said fluidized bed is less than about 200° C.

4. The process of claim 3 wherein said temperature is in the range of from about 70° C. to about 160° C.

5. The process of claim 1 wherein said mixture comprising the surfactant and from 20%–80% by weight water is a flowable and a pumpable paste.

6. The process of claim 15 wherein said mixture contains from 30% to about 50% by weight water.

7. The process of claim 1 wherein said water-soluble solid is selected from the group consisting of soda, an alkali metal silicate, water soluble alkali metal phosphates and sodium sulfate.

8. The process of claim 1 wherein said water-insoluble solid is selected from the group consisting of zeolite NaA, hydrotalcite, crushed rock, or crystalline layer silicate.

9. The process of claim 1 wherein said solids are the granules produced in said process.

10. The process of claim 1 wherein a polyacrylatehomopolymer or copolymer having a molecular weight in the range of about 30,000 to about 100,000 is introduced into said mixing zone.

11. The process of claim 1 wherein the at least one solid comprises sodium carbonate.

12. The process of claim 1 wherein the at least one solid comprises solids which are useful in detergent formulations.

13. The process of claim 1 wherein the dried granules contain at least 25% by weight of the surfactant.

14. The process of claim 1 wherein before drying, the granules are powdered with the solid.

15. The process of claim 1 wherein the granules before drying contain a solid with water of hydration and the granules are dried to an extent that at least a portion of the water of hydration is removed.

16. A process of claim 1 wherein the surfactant is selected from the group consisting of fatty alcohol sulfates, sulfofatty acid methyl esters, alkyl glycosides and alkyl benzene sulfonates.

* * * * *